United States Patent [19]

Sensenbrenner

[11] Patent Number: 4,718,957

[45] Date of Patent: Jan. 12, 1988

[54] PROCESS OF CREATING AN ARTIFICIAL FINGERNAIL

[76] Inventor: Kenneth C. Sensenbrenner, 919 W. Kirby, Champaign, Ill. 61820

[21] Appl. No.: 889,822

[22] Filed: Jul. 24, 1986

[51] Int. Cl.[4] ..... B29C 41/02

[52] U.S. Cl. ..... 156/152; 156/242; 156/245; 156/246; 156/289; 156/306.6; 156/307.1; 264/220; 264/222; 264/227; 132/73; 132/88.5

[58] Field of Search ..... 156/242, 245, 247, 289, 156/306.3, 306.6, 307.1, 152; 264/220, 222, 227; 132/1 R, 73, 88.5, 249, 344, 246

[56] References Cited

U.S. PATENT DOCUMENTS

| | | | |
|---|---|---|---|
| 2,073,867 | 3/1937 | Reigerbaum | 132/73 |
| 3,037,514 | 6/1962 | Lappe | 264/222 |
| 3,786,821 | 1/1974 | Noskin | 132/88.5 |
| 4,222,983 | 9/1980 | August et al. | 264/222 |
| 4,361,160 | 11/1982 | Bryce | 132/73 |
| 4,552,160 | 11/1985 | Griggs | 132/88.5 |
| 4,587,983 | 5/1986 | Wissman et al. | 132/73 |
| 4,605,024 | 8/1986 | Tremblay | 132/88.5 |
| 4,643,208 | 2/1987 | Amour | 132/88.5 |

*Primary Examiner*—Caleb Weston

*Attorney, Agent, or Firm*—Laff, Whitesel, Conte & Saret

[57] ABSTRACT

The process for fabricating a reusable artifical fingernail which enjoys a tight tolerance complimental fit with the natural nail substrate as a result of the method of fabrication. The process may involve the use of, (A) the natural nail [Direct Technique], of (B) a model of the natural [Indirect Technique] as a substrate in conjunction in each case with a secondary substrate forming an extension of the nail, and digit to accept in a continuous fashion a release agent and a coating of a curable material forming an artifical nail curing the acrylic material, preferrably by blue light source in the visible spectrum. The preferable material is an acrylic and removing the artifical nail so created, trimming flash and shaping it to the desired final configuration and reapplying with a non-permanent adhesive material.

38 Claims, 10 Drawing Figures

PROCESS OF CREATING AN ARTIFICIAL FINGERNAIL

This invention relates to two techniques or methods of fabricating a means for protecting the horny plate of thickened and condensed epithelial stratum lucidum that grows out from a vascular matrix of cutis and normally sheathes the upper surface of the ends of the digits of homo sapiens, commonly known as finger nails and toe nails. The protection may be required because of physical damage to such nails or for purposes of beautification by extending the length of such nails beyond normal limits.

In the past, artificial fingernails have been fabricated from a cellulose or 'Celluloid' type product in which the nails were preformed, and attempts were made to cause these nails to conform to the shape of the existing human nail. Unfortunately, they normally did not permit much adaptation and the glue that was supplied did not work well. It is a well known fact that the effectiveness of adhesive materials is inversely proportional to the amount of air gaps between the mating surfaces. The tighter the complimental fit, the better the adhesion. There was a tendency for the sides of the prior art preformed nail to pop outwardly from the natural finger curvilinear configuration back to their initially formed curved shape. The glue, unfortunately, did not hold the nails in place and quite often they would cause serious damage to the nails when these artificial 'Celluloid' type products were removed.

Another variety of artificial fingernail involved the usage of a cardboard and aluminum foil underlayment member which was cut by the user to approximate the configuration of the exterior of the finger at its extremity, with this cardboard and foil underlayment being positioned under the extremity of the nail. Then the entire nail as well as the cardboard and aluminum foil underlayment were covered with an acrylic material. The paper was then removed and it was necessary to configure that portion of the acrylic which had been formed on top of the cardboard-aluminum foil laminate to approximate the end of the natural nail. One deleterious problem is that the acrylic material was not removable from the natural nail without destroying the nail bed, hence, this artificial fingernail was not reusable. When they came off they either broke, peeled, or destroyed the natural nail bed by breaking it off very unevenly.

The present invention utilizes a different approach which overcomes the problems which were present in the prior inventions and which makes a reusable nail which can be and will be of greater benefit to the user.

Another major advantage of the present invention is that it can control the contour of that portion of the artificial fingernail which extends into the flesh bed, flesh bed by definition being the cuticle and side portions of the fleshy portion of the end of a digit surrounding a nail.

Additionally, it is well known that each individual nail has a series of longitudinally extending striations or grooves which are a natural function of the growth of a horny plate. By utilizing the method of fabrication of the present invention, it is possible to create an artificial nail which is substantially complimentary to the natural nail. It is well known in the application of underlying or juxtaposed devices, i.e. prosthetic devices in dental work, such as crowns, etc., that when tight tolerances are produced and there are fewer air spaces that there is a greater bonding power. It is in this direction that the present invention strives to produce an artificial fingernail which is so complimentary to the surface of the natural nail that it will ensure a firm bonding.

A further advantage of the present invention is that it produces a "controlled" removal. Therefore, the finger nails that are produced can be removable and replaceable in substantially the same position. This is accomplished by utilizing a separating medium which is capable of permitting separation from the natural nail or a model of said nail under controlled conditions and removal of the medium from the artificial nail.

The broad process contemplated by the present invention includes the usage of: (A) the natural nail as a primary substrate (direct technique); or (B) a working model of the nail as a primary substrate (indirect technique): either of which being usable in combination with a secondary substrate in the form of a tacky hardenable material which can be applied to the end of the natural or artificial digit adjacent the nail and caused to extend outwardly from the terminal end of such digit be it a finger or toe; shaping the primary and secondary substrates so they provide a substantially continuous outwardly extending surface or support means; applying a separating medium to the upper surface of the substrate; applying an acrylic substance to the primary and secondary substrates on top of the separating medium; curing the acrylic and finally removing the artificial fingernail so produced from the primary and secondary substrates, removing the secondary substrate and trimming the cured acrylic nail so that it may be refastened by suitable adhesive means to the natural nail.

The indirect technique involves the use of an artificial model of the finger and fingernail. An appropriate impression material that accurately reproduces the finger and nail are such as the following: aliginate, hydrocolloid, polysulfide, polysiloxane, polyether, silicone, or other known thermoplastic compounds. These are common impression materials used in dentistry to make intraoral impressions in order to make an accurate model for the precise construction of modern crowns, bridges, dentures, and/or partial dentures.

In this method a clean, dry fingernail is positioned in such a manner that it can be impressed into one of the aforementioned impression materials positioned in an impression tray and then allowing the material to cure. This produces an undistorted, accurate negative impression or mold, like a negative in photography. Using this impression as a mold and filling same with an appropriate material such as a calcium sulfate dihydrate derivative (dental plaster, die stone) or a dental epoxy. A permanent reproduction of the natural nail and digit is fabricated which may serve as a working model for construction of an artificial nail. Such models may be saved for future use, should repairs be necessary or other substances be employed, to fabricate an artificial nail such as gold/silver/porcelain, which require longer procedures and would be impractical to utilize a natural nail for the substrate.

Other advantages will be apparent to those skilled in the art when the specification is read in conjunction with the attached drawings wherein:

FIG. 1. is a partial side elevation of the end of a finger, either natural or artificial, showing the secondary substrate in position;

FIG. 2. is a similar side elevational view showing the use of an abrading tool for contouring the upper surface of the hardened secondary substrate;

FIG. 3. is a similar side elevational view showing a release means in cross-section applied to the primary and secondary substrates;

Figure 1:
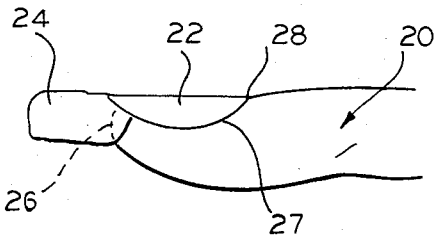

Referring now to the drawings wherein similar parts are designated by similar numerals; each of the drawings generally shows the extension of a finger from the first knuckle out to the extremity of the digit. While the finger, be it natural or artificial, is shown in life size fashion, the release coat and the artificial fingernail is shown exaggerated in thickness for clarity of illustration.

Figure 2:
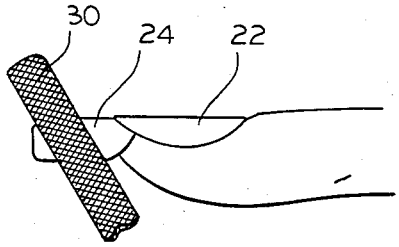
Figure 3:
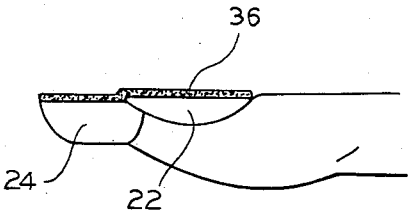

As seen in FIG. 1, the secondary substrate 24 is applied to the terminal end of the finger or a model of the finger 20 adjacent the primary substrate, nail 22. The preferrable material for this application is base plate wax, such as used in dentistry. This material is initially tacky and will adhere readily to the fleshy pad 26 found at the extremity of the finger 20 as well as adhering to the flesh bed 27 adjacent to the natural nail 22. At the base 28 of the nail is the cuticle area of the finger nail. The nail 22 serves as the primary substrate for the formation of the artificial nail while the secondary substrate 24, which is initially tacky, will harden up to provide a surface which can be easily worked. Substrate 24 usually is formed by manipulation to a desired configuration, and, when it has hardened adequately it can be worked to a smooth surface by abrasion, as seen in FIG. 2. In this instance the secondary substrate 24 is shown being smoothed over by a file or emery board 30 until it is contoured to generally match an extension of the contours of the extremity of the natural nail 22.

Figure 5:
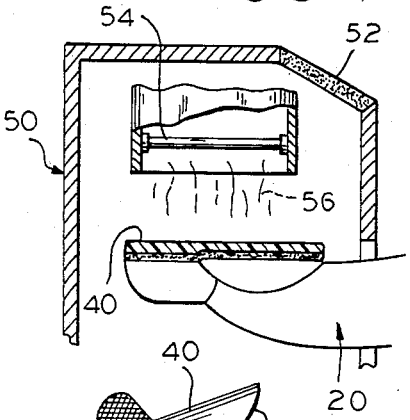
FIG. 5 is a side exploded elevational view in partial section showing the use of a curing means for a quick cure of the acrylic material.
Figure 4:
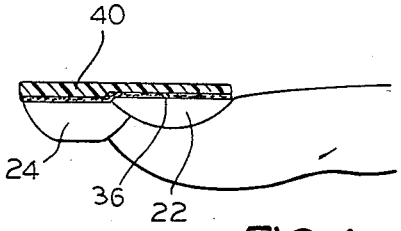
FIG. 4 is a similar side elevational partial view showing an acrylic material in exaggerated cross-section as applied to the upper surface of the release mechanism.

A separating medium or release agent 36, such as: petroleum jelly, liquid alginate, or the like, is applied in a continuous coat over the primary and secondary substrates 22 and 24. When the release coat 36 has dried, an application is then made either by brushing or spraying an acrylic material 40 on top of the release coat in a continuous fashion, as seen in FIG. 4, so as to overlie the primary and secondary substrates 22 and 24 in a predetermined thickness with feathered edges 46. The preferred material is BIS-GMA, namely, bisphenol-A and glycidyl methacrylate, which can be quickly cured by the application of exposure to a particular light source. In the present instance the acrylic material is hardened within approximately 20 seconds when exposed to a blue light in the visible spectrum having a wave length of approximately 480 nanometers. This acrylic material cures quite rapidly in this blue light, however, it is necessary to utilize eye protection by interposing a filter medium which is capable of filtering out the blue light. This can be supplied by exposing the fingernails to the particular light within a housing. Repeated viewing of these rays could ultimately produce cataract conditions if an eye is extensively viewed. As seen in FIG. 5, the finger may be inserted within a schematic box 50 having an opening covered by a filter medium 52 in one corner thereof to permit viewing the nail while light source 54 giving off its rays 56 is used to cure the acrylic coating 40 forming the artifical nail.

Figure 6:
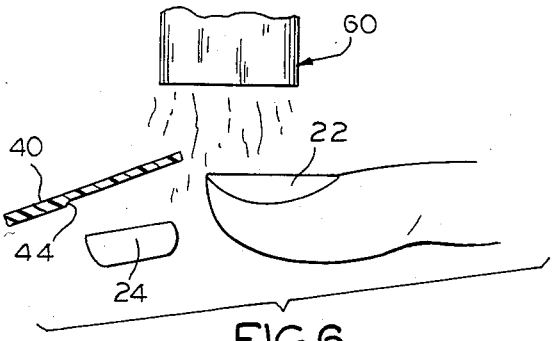
FIG. 6 is an exploded view showing the application of a heat source to the cured fingernail as well as the secondary substrate so that it is removed from the basic substrate, i.e. the fingernail.

Once the acrylic artificial nail 40 has been cured it can be removed by application of a heat source to the release coat 36. As viewed in FIG. 6, a heat source 60 will cause the release coat 36 to soften and permit removal of the artificial acrylic nail from the nail substrate 22 and may or may not at that time cause a release of the secondary substrate from the finger and the nail. By utilizing a heat source such as warm water it is also possible to remove the release coat 36 by dissolving it in the warm water.

Figure 7:
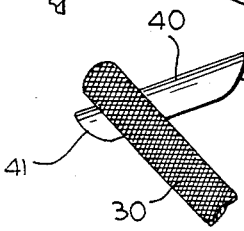
FIG. 7 is a side partial view of an abrading tool trimming a cured acrylic artificial nail.

The artificial nail 40 can then by trimmed, as seen in FIG. 7, to provide a proper contour at its outer extremity 41 for aesthetic purposes as well as to trim up the flash 46 at the opposite end 42 where it will engage the cuticle area 28 of the nail as well as the fleshy bed portion 27. In addition to BIS-GMA, other materials may be employed to create the artificial nail by using either the direct or indirect technique. Gold, silver, or any other of the castable metals may be the final artificial nail by using the common "lost-wax" casting process, either directly or indirectly. Porcelain may also be used via the indirect technique. Using a plaster model of the fingernail and a platinum foil as the separating medium, over the model nail, a porcelain artificial nail may be fabricated upon the separating medium, removed from the model and then baked appropriately to vitrification. Subsequent finishing and polishing will produce the final reusable nail.

The final step in the process is the reapplication of the artificial nail to the primary substrate or natural nail 22 by use of a suitable adhesive means 70. Various types of adhesive materials or cements can be utilized for holding the artificial nail on the natural nail, for example, in the event that a very tight semi-permanent bond is desired, it is possible to use a strong adhesive such as a cyanoacrylate particularly where the artificial nail 40 is being used to protect a natural nail which may have been previously damaged. Where the artificial nail 40 is being used for cosmetic reasons, then a lesser strength adhesive will provide adequate holding power since the under side of the false nail complimentally matches the contour and ridges of the existing nail 22. For example, in this latter case it is possible to use household or rubber cements which do not have an extremely high holding power and hence can be removed quite readily upon mechanical manipulation.

Figure 9:
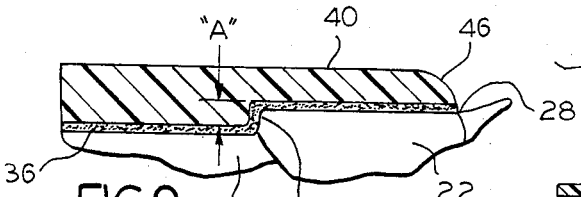
FIG. 9 is an enlarged partial view in cross section showing one embodiment for the use of the process of the present invention.
Figure 8:
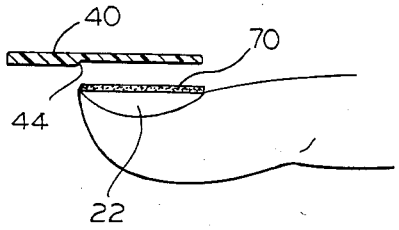
FIG. 8 is an exploded side elevational view in partial section showing the reapplying of a trimmed artificial fingernail after application of an adhesive material to the natural nail.

Variations within the process which has been described are possible. For example, in the initial step of utilizing the secondary substrate 24 affixed to the terminal end of the finger 20, it is possible to form the upper surface of substrate 24 so as to match the extension of the under surface of the nail. For example, in FIG. 9 the dimension "A", as shown by the arrows, is an exaggerated representation of the thickness of the nail. When the secondary substrate 24 is contoured or fashioned at this lower level, you then produce a step or shoulder in the release coat and artificial nail equivalent to the thickness "A". This permits the usage of the end of the nail as a stop means for prepositioning the artificial nail in a longitudinal direction relative to the natural nail 22. Thus, as the natural nail 22 grows and the artificial nail 40 is moved outwardly it is possible to remove the artificial nail 40, trim the natural nail and then utilize the shoulder 44, shown in exaggerated form, to bear against the terminal end of the natural nail 22 and thereby reposition the artificial nail in a natural looking position. It will be noted that this step shoulder 44 is illustrated in FIGS. 4, 5, 6, and 8.

Figure 10:
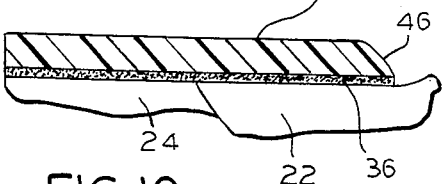
FIG. 10 is an enlarged partial side elevational view in cross section showing another configuration utilizing the process of the present invention.

A secondary embodiment is shown in FIG. 10 wherein the secondary substrate 24 is trimmed and contoured to be "co-planar", if you will, relative to the upper surface of the natural nail 22 and serves as an intimate extension thereof. Thus, it will be noted that the release means 36 and the acrylic overlay or artificial nail is substantially uniform in thickness throughout its extent as opposed to the stepped or shouldered configuration previously described.

Thus, the process described by the present invention has distinct advantages over the prior art. The contour of the portion of the nail which extends into the flesh bed surrounding the horny portion can be controlled by feathering to look like a natural nail. Proper selection of the release medium makes it possible to control the popping off or removability of the nail. Controlling the choice of the adhesive permits you to make the nail both removable as well as replaceable. A preferred separating medium is chosen from the class of: petroleum jelly, liquid alignate, or the like, except when porcelain is used in the indirect method.

An ideal secondary substrate 24 has been found to be a material such as base plate wax, such as used in dentistry. It has been found that dental wax used for making impressions is ideally suited for this application since it basically is tacky and will stay where it is put against a flesh material and will harden up to a general contour in a very brief period of time, which contour can be mechanically worked by abrasive means such as an emory board or file.

As indicated above, the preferred acrylic material is bisphenol-A and glycidyl methacrylate which is light activated, mainly because these materials are quick curing and will harden under those circumstances. Similar materials are available which will cure under ambient conditions but take a longer time. Basically the object is to make an artificial nail which is as thin as practicable, approximately ½ millimeter in thickness. It has been found that the acrylic material in this thickness can be cured by exposure to blue light in the visible spectrum having a wave length approximately 480 nanometers for approximately 20 seconds. The BIS-GMA material is ideally suited since it is hypo-allergenic and will not affect the users in the same fashion as the prior art. Previously some of the so-called sculptured nails utilized methyl-methacrylate which not only causes an allergic reaction with certain people but similarly there is a definite difficulty in removal of this material from the natural nail. When it does come off, it comes off in pieces and causes the natural nail bed to be damaged. The method utilized in the present invention alleviates and eliminates these problems by providing a release agent that is very thin in configuration and permits the contour and ridges of the natural nail to be formed on the under surface of the artificial nail 40. The material chosen does not cause the allergic reactions of the prior art and results in a nail 40 which substantially matches and is complimentary to the natural nail or primary substrate 22. Thus, a very thin coat of adhesive 70 will result in excellent adhesion of the artificial nail 40 to the natural nail 22.

The advantages of the present invention will be apparent to those skilled in the art when the drawings and the specification are compared to the attached claims.

I claim:

1. A process of creating an artificial fingernail intimately complimentary to and juxtaposed to the primary substrate of a natural fingernail and with said artificial nail extending outwardly beyond the terminal extremity of said natural nail, comprising the steps of:

(a) applying a secondary substrate means to the fleshy extremity of a natural finger to provide support means subjacent the area to be covered by the artificial finger nail;

(b) contouring the upper surface of said secondary substrate;

(c) applying a continuous release coat over the natural nail substrate and the secondary substrate;

(d) applying a curable continuous coating of acrylic simultaneously over the release coat covering both the natural nail substrate and the secondary substrate;

(e) curing said acrylic until it hardens into the initial shape of the desired artificial nail;

(f) removing said acrylic nail from the natural nail and secondary substrates by activating and softening said release coat;

(g) finishing the artificial nail to its desired shape; and (h) re-applying the artificial nail to the natural nail by adhesion means adapted to permit electable removal.

2. The process of claim 1 wherein said secondary substrate means is initially tacky and adherable to the fleshy part of the finger and adapted to be formable into an initial configuration simulating an extension of the extremity of the natural finger nail and finger.

3. The process of claim 2 wherein the secondary substrate means is hardenable to a degree adequate to permit mechanically working the surface thereof to produce the desired curvlinear configuration of a subjacent extension of the natural nail.

4. The process of claim 3 wherein the process of mechanically working includes the step of removal of material by abrasion to reach the final desired configuration of said secondary substrate.

5. The process of claim 4 wherein the process of abrasion is accomplished by use of a hand held and operated abrasion means.

6. The process of claim 1 wherein said upper surface of said secondary substrate is mechanically worked so as to be substantially co-planar with the under surface of the natural nail whereby continuous applications of said release coat and then said acrylic results in an acrylic artificial nail having a step formed intermediate its extremities and adapted to be positioned at the terminus of the free end of the natural nail, said step having a dimension similar to the thickness of said natural nail.

7. The process of claim 1 wherein the contoured upper surface of the secondary substrate is mechanically worked so as to be a substantially co-planar extension of the upper exposed surface of the primary natural finger nail substrate whereby said artificial acrylic nail is formed with a substantially continuous uninterrupted under surface complimentary to the exposed surface area of the natural nail and extending outwardly beyond the terminus thereof in a generally co-planar fashion.

8. The process of claim 1 wherein said formable secondary substrate is a dental impression material capable of setting-up to maintain a desired shape and hardness.

9. The process of claim 1 wherein the step of contouring said formable secondary substrate includes contouring said secondary substrate to conform to the shape of the natural fingernail at the juncture of the natural fingernail and the flesh bed of the finger surrounding the natural finger nail substrate.

10. The process of claim 1 wherein said acrylic is cured by an actinic light source.

11. The process of claim 10 wherein said acrylic is cured by blue light in the visible spectrum.

12. The process of claim 1 wherein said release coat is activated by application of a heat source thereto.

13. The process of claim 12 wherein the said heat source is warm water.

14. The process of claim 1 wherein the said acrylic is bisphenol-A and glycidyl methacrylate.

15. The process of claim 14 wherein said acrylic is light activated by a 480 nanometer blue light in the visible spectrum.

16. A process of creating an artificial finger nail intimately complimentary to and juxtaposed to the primary substrate of a natural nail and with said artificial nail extending outwardly beyond the terminal extremity of said natural nail, comprising the steps of:

(a) forming a model of a natural finger and fingernail by using an appropriate impression material to form a negative cavity mold, casting a positive form in said mold using a material from the group consisting of: dental gypsum and epoxy:

(b) applying a secondary substrate means to the model of the finger to provide support means subjacent the area to be covered by the artificial finger nail;

(c) contouring the upper surface of said secondary substrate;

(d) applying a continuous release coat over the primary and secondary substrates;

(e) applying a curable continuous coating of acrylic simultaneously over the release coat covering both the primary artificial nail substrate and the secondary substrate;

(f) curing the said acrylic until hardened into the initial shape of the desired artificial nail;

(g) removing the said acrylic nail from the model nail and secondary substrate by activating and softening said release coat;

(h) finishing the artificial nail to its desired shape on the model; and (i) reapplying the artificial nail to the natural nail by adhesion means adapted to permit electable removal.

17. The process of claim 16 wherein said secondary substrate means is initially tacky and adherable to the model of the finger and the fingernail and adapted to be formable into an initial configuration simulating an extension of the extremity of the natural nail and finger.

18. The process of claim 17 wherein the secondary substrate means is hardenable to a degree adequate to permit mechanically working the surface thereof to produce the desired curvilinear configuration if a subjacent extension of the natural nail.

19. The process of claim 18 wherein the process of mechanically working includes the step of removal of material by abrasion to reach the final desired configuration of said secondary substrate.

20. The process of claim 19 wherein the process of abrasion is accomplished by use of a hand held and operated abrasion, means.

21. The process of claim 16 wherein said upper surface of said secondary substrate is mechanically worked so as to be substantially co-planar with the upper surface of the natural nail whereby continuous application of appropriate release coat and then said workable material results in an artificial nail having a step, formed intermediate its extremities, and adapted to be positioned at the terminus of the free end of the natural nail, and said step having a dimension similar to the thickness of said natural nail.

22. The process of claim 16 wherein the contoured upper surface of the secondary substrate is mechanically worked so as to be substantially co-planar extension of the upper exposed surface of the primary model of the natural finger substrate whereby said artificial nail is formed with a substantially continuous uninterrupted under-surface complimentary to the exposed area of the natural nail and extending outwardly beyond the terminus thereof in a generally co-planar fashion.

23. The process of claim 16 wherein said formable secondary substrate is a dental restorative material capable of setting up to maintain a desired shape and hardness.

24. The process of claim 16 wherein the step of contouring said formable secondary substrate includes extending and contouring said secondary substrate to conform to the shape of the model of the natural fingernail at the juncture of the model of the nail and model of the flesh bed of the finger surrounding the fingernail substrate.

25. The process of claim 16, wherein said acrylic is cured by an actinic light source.

26. The process of claim 25 wherein said acrylic is cured by blue light in the visible spectrum.

27. The process of claim 16 wherein said acrylic is itself employed as a model cast in appropriate metal via the "lost-wax" process.

28. The process of claim 16 wherein said release coat is activated by applying a heat source thereto.

29. The process of claim 28 wherein the said heat source is warm water.

30. The process of claim 16 wherein said acrylic may also be methyl methacrylate when said artificial nail comprises a castable metal product.

31. The process of claim 16 wherein said acrylic is bisphenol-A and glycidyl metharylate.

32. The process of claim 31 wherein said acrylic is light activated and cured by a 480 nanometer wavelength blue light in the visible spectrum.

33. The process of claim 16, wherein said finished nail can be used in the lost wax casting process to create castable metallic fingernails.

34. The process of claim 33 wherein the castable metal is gold.

35. The process of claim 33 wherein the castable metal is silver.

36. A process of creating an artificial finger nail intimately complimentary to and juxtaposed to the primary substrate of a natural nail and with said artificial nail extending outwardly beyond the terminal extremity of said natural nail, comprising the steps of:

(a) forming a model of a natural finger and fingernail by using an appropriate impression material to form a negative cavity mold, casting a positive form in said mold using a material from the group consisting of: dental gypsum and epoxy:

(b) applying a secondary substrate means to the model of the finger to provide support means subjacent the area to be covered by the artificial finger nail;

(c) contouring the upper surface of said secondary substrate;

(d) applying a continuous release coat over the primary and secondary substrates;

(e) applying a curable continuous coating of porcelain simultaneously over the release coat covering both the primary artificial nail substrate and the secondary substrate;

(f) curing the said porcelain until hardened into the initial shape of the desired artificial nail;

(g) removing the said porcelain nail from the model nail and secondary substrate by activating said release coat by mechanical manipulation;

(h) finishing the artificial nail to its desired shape of the model; and (i) applying the artificial nail to the natural nail by adhesion means adapted to permit electable removal.

37. The process of claim 36 wherein said release coat is a thin metal foil.

38. The process of claim 36 wherein said release coat is a thin metallic malleable foil and said curable coating is a vitrifiable porcelain material.

* * * * *